US006565734B2

(12) United States Patent
Kim et al.

(10) Patent No.: US 6,565,734 B2
(45) Date of Patent: May 20, 2003

(54) ELECTROCHEMICAL PROCESS USING CURRENT DENSITY CONTROLLING TECHNIQUES

(75) Inventors: Soo-Hyun Kim, Taejon (KR); Young-Mo Lim, Yongin (KR); Hyung-Jun Lim, Taejon (KR)

(73) Assignee: Korea Advanced Institute of Science and Technology, Taejon (KR)

( * ) Notice: Subject to any disclaimer, the term of this patent is extended or adjusted under 35 U.S.C. 154(b) by 0 days.

(21) Appl. No.: 09/817,582

(22) Filed: Mar. 26, 2001

(65) Prior Publication Data

US 2002/0040854 A1 Apr. 11, 2002

(30) Foreign Application Priority Data

Oct. 5, 2000 (KR) ..... 2000-58439

(51) Int. Cl.[7] ..... C25F 3/00; C25F 7/00
(52) U.S. Cl. ..... 205/645; 205/674
(58) Field of Search ..... 205/645, 674, 205/660, 664, 686

(56) References Cited

U.S. PATENT DOCUMENTS 5,507,924 A * 4/1996 Mikumo et al. ..... 205/641
5,622,636 A * 4/1997 Huh et al. ..... 205/645 X
5,942,100 A * 8/1999 Sauerland ..... 205/645

* cited by examiner

*Primary Examiner*—Donald R. Valentine
(74) *Attorney, Agent, or Firm*—Merchant & Gould P.C.

(57) ABSTRACT

An electrochemical process using current density controlling techniques is disclosed. In the electrochemical process of this invention, a carbon cathode rod activated with a negative voltage and an electrode activated with a positive voltage are sunk into an electrolyte contained in a container, and so the electrode is electrochemically etched while properly controlling both the metal ion dissolving rate and the metal ion diffusing rate of the electrode by controlling the amount of applied current to maintain the two rates at a desired balance. This process thus creates a diffusion effect thickening the tip of the cylindrical electrode, and compensates for a conventional geometric effect sharpening the tip of the electrode. Therefore, this process produces a precise product having a uniform diameter along its length. In the electrochemical process of this invention, the electrode is ultrasonically washed on its surface with both acetone and distilled water before the process so as to remove impurities from the surface of the electrode. In addition, the electrolyte is a potassium hydroxide solution having a molar density of 4~6 M.

11 Claims, 5 Drawing Sheets

ELECTROCHEMICAL PROCESS USING CURRENT DENSITY CONTROLLING TECHNIQUES

BACKGROUND OF THE INVENTION

1. Field of the Invention

The present invention relates to electrochemical processes for removing excess metal by electrolytic dissolution, effected by a counter electrode acting as the cathode against an electrode acting as the anode and, more particularly, to an electrochemical process using current density controlling techniques, designed to electrochemically machine electrodes while controlling the amount of an applied electric current, thus effectively producing a precise product having a uniform shape in addition to precise products having a variety of shapes.

2. Description of the Prior Art

As well known to those skilled in the art, an electrochemical process, also known as an electrolytic process, means a process, in which an electrode in an electrolyte is electrochemically reacted in response to applied voltages to be dissolved into the electrolyte. Such an electrochemical process is typically carried out in four steps as follows.

That is, the conventional electrochemical process comprises the first step of transferring the ions of the electrolyte to the surface of an electrode, the second step of reacting the metal atoms of the surface of the electrode with the transferred ions of the electrolyte to form particles, the third step of changing the particles into stable ions, and the fourth step of diffusing the stable ions into the electrolyte.

Such electrochemical processes are also classified as electrochemical polishing and electrochemical etching in accordance with results from a comparison of the processing rate of the second step with the processing rate of the third step. That is, the first processing rate when the metal atoms of the surface of the electrode are reacted with the transferred ions of the electrolyte to form, particles in the second step and the second processing rate when the particles are changed into stable ions in the third step are primarily measured prior to comparing the two processing rates with each other. When the first processing rate is higher than the second processing rate, the electrochemical process is an electrochemical polishing. When the first processing rate is lower than the second processing rate, the electrochemical process is an electrochemical etching. During such electrochemical processes, the difference between the processing rates in the above-mentioned four steps is an important factor that determines the surface conditions of the electrode in addition to the machined shape of the electrode. On the other hand, the metal dissolution rate in an electrochemical process is determined by the fourth step of diffusing the stable ions into the electrolyte.

Of the conventional electrochemical processes, the electrochemical etching is used specifically for machining micro probes having a precision of several nanometers. The electrochemical etching for machining such micro probes is typically performed with somewhat low concentrations of electrolytes and electric current. During an electrochemical etching for machining a micro probe, the metal dissolution rate is higher at the tip of the probe having a large curvature than the sidewall of said probe, thus making the tip have an unwanted conical shape. Such an effect of undesireably forming the conical tip during an electrochemical etching is a so-called "geometric effect" in the art.

However, such conventional electrochemical etching has the following problems.

That is, the processing conditions for an electrode during an electrochemical etching are different in accordance with the depths of the parts of said electrode within an electrolyte, and so the metal dissolution rate of the electrode is partially uneven. It is thus almost impossible for the conventional electrochemical etching to produce a precise product having a uniform shape. Another problem experienced in the conventional electrochemical etching resides in that it is almost impossible to produce precise products having a variety of shapes due to the nonuniform metal dissolution rates.

SUMMARY OF THE INVENTION

Accordingly, the present invention has been made keeping in mind the above problems occurring in the prior art, and an object of the present invention is to provide an electrochemical process using current density controlling techniques, which electrochemically machines an electrode while controlling the amount of an applied electric current, thus effectively producing a precise product having a uniform shape.

Another object of the present invention is to provide an electrochemical process using current density controlling techniques, which electrochemically machines electrodes while controlling the amount of an applied electric current, thus producing precise products having a variety of shapes.

In order to accomplish the above object, the present invention provides an electrochemical process using current density controlling techniques, comprising: a contact point measuring step of sinking a cathode rod activated with a negative voltage into an electrolyte within a container, and feeding a cylindrical electrode having a predetermined length and activated with a positive voltage to the surface of the electrolyte until the electrode comes into contact with the electrolyte while measuring a contact point, at which an electric current initially flows into the electrolyte; an etching preparing step of feeding the electrode to the surface of the electrolyte and removing the applied voltage from the electrode, and sinking the electrode in the electrolyte by a length, which is predetermined on the basis of the contact point and to which the electrode has to be machined; an initial value setting step of setting a target length of the electrode, a target diameter of the electrode, an electrochemical equivalent volume constant of the electrode, a current density, and etching intervals; [a] an etching step of applying voltages to both the electrode and the cathode rod to electrochemically machine the electrode while continuously calculating and measuring a variable surface area of the electrode, the amount of applied current, the amount of electricity according to the applied current, and a variable diameter of the electrode in accordance with the lapse in etching time; and a process-end determining step of determining whether the diameter of the machined electrode from the etching step is equal to the target diameter, thus repeating the etching step until the target diameter of the electrode is accomplished or stopping the etching step when the target diameter of the electrode is accomplished.

In the above-mentioned electrochemical process, the variable surface area of the electrode during the electrode etching step is calculated by the expression, $A_m=\pi[LD+h(D_o+2D)/3]$, wherein $A_m$ is the variable surface area ($mm^2$) of the electrode during etching, L is a target length (mm) of the electrode, h is an additional increase (mm) of the contact position of the electrolyte surface, D is the variable diameter (mm) of the electrode during etching, and $D_o$ is an original diameter (mm) of the electrode.

In addition, the amount of applied current during the etching step is calculated by the expression, $i=A_mJ$, wherein i is the applied current (C/sec) during a unit of time, $A_m$ is the variable surface area ($mm^2$) of the electrode during etching, and J is the current density ($C/mm^2sec$).

The amount of electricity during the etching step is calculated by the expression, $Q_t=Q_p+i\Delta t$, wherein $Q_t$ is the total amount of applied electricity (C) during etching, $Q_p$ is the amount of electricity (C) applied during the previous step, and $\Delta t$ is a variable etching time (sec).

In addition, the variable diameter of the electrode during the etching step is calculated by the expression, $\pi(D_o-D)[L(D_o+D)/4+h(3D_o+2D)/15]\alpha_e=Q_t$, wherein D is the variable diameter (mm) of the electrode during etching, $D_o$ is the original diameter (mm) of the electrode, $Q_t$ is the total amount of applied electricity (C) during etching, L is the target length (mm) of the electrode, h is the contact length (mm) of the electrode due to the surface tension, and $\alpha_e$ is the electrochemical equivalent volume constant ($mm^3/C$) of the electrode.

In the electrochemical process of this invention, both the metal ion dissolving rate and the metal ion diffusing rate of the electrode are controlled by controlling the amount of the applied current.

In addition, the cathode rod may be somewhat freely selected from a variety of conductive rods, but it is preferable to use a carbon rod as the cathode rod.

The electrolyte may be selected from a variety of conventional acid solutions or basic solutions, which have been typically used in such electrochemical processes. But, it is preferred to use a potassium hydroxide solution having a molar density of 4~6 M as the electrolyte in the etching process of this invention.

In the electrochemical process, the electrode is ultrasonically washed on its surface with both acetone and distilled water before the contact point measuring step so as to remove impurities from the surface of the electrode.

On the other hand, the additionally machined volume of metal of the electrode due to the surface tension in the electrochemical process is calculated by the expression, $Vp=\pi h(-2D^2-D_oD+3D_0^2)/15$, wherein $V_p$ is the additionally machined volume ($mm^3$) of metal of the electrode due to the surface tension, h is the contact length (mm) of the electrode due to the surface tension, D is the variable diameter (mm) of the electrode during etching, and $D_o$ is the original diameter (mm) of the electrode.

BRIEF DESCRIPTION OF THE DRAWINGS

The above and other objects, features and other advantages off the present invention will be more clearly understood from the following detailed description taken in conjunction with the accompanying drawings, in which.

DETAILED DESCRIPTION OF THE INVENTION

Figure 1:
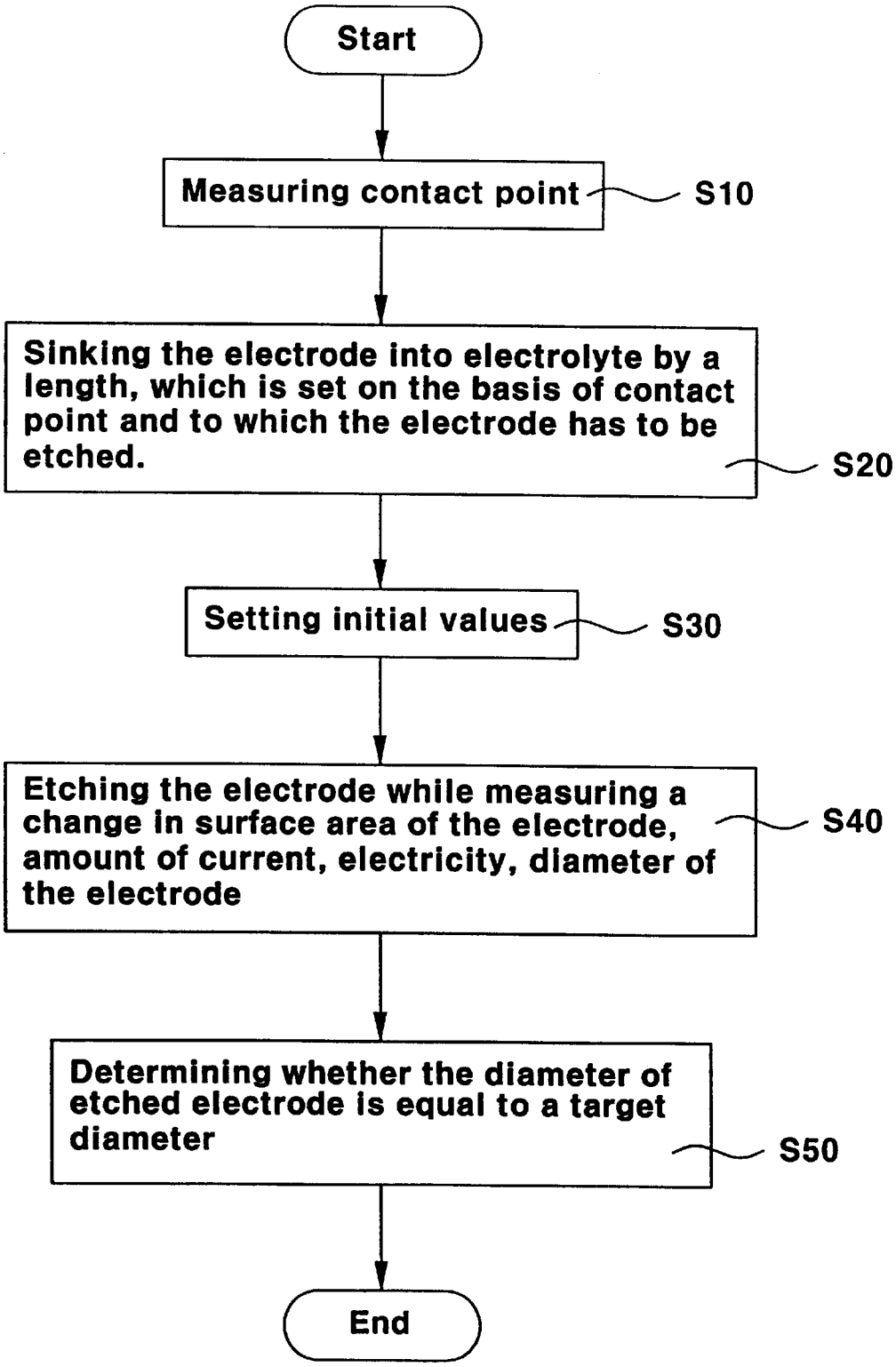
FIG. 1 is a flowchart of an electrochemical process using current density controlling techniques in accordance with the preferred embodiment of the present invention.

In the description of this invention, the technical term "electrochemical process" means a process, in which excess metal of an electrode is removed by electrolytic dissolution, effected by the transferring of ions of an electrolyte to the electrode while controlling its current density with a counter electrode acting as the cathode against the electrode acting as the anode. When the electrochemical process is performed with the electrode brought into contact with the counter electrode, the process is a so-called "electrochemical grinding process". On the other hand, when the electrochemical process is performed with the electrode spaced apart from the counter electrode, the process is a so-called "electrolytic-type carving process". When the term "electrochemical process" is used without specific restriction in meaning, the process is typically regarded as the electrolytic-type carving process.

When voltages are applied to both the counter electrode acting as the cathode sunk into the electrolyte and the electrode acting as the anode during an electrochemical process, electrons of the electrode acting as the anode are changed into metal ions prior to being dissolved into the electrolyte. On the other hand, the ions of the counter electrode acting as the cathode receive the electrons, and are changed into atoms or particles prior to being deposited. That is, an oxidation occurs in the electrode, while a reduction occurs in the counter electrode. During the electrochemical process, the electrode acting as the anode is dissolved into the electrolyte, thus electrochemically forming a desired product.

Reference now should be made to the drawings, in which the same reference numerals are used throughout the different drawings to designate the same or similar components.

FIG. 1 is a flowchart of an electrochemical process using current density controlling techniques in accordance with the preferred embodiment of the present invention. As shown in the flowchart, the electrochemical process of this invention comprises five steps: a contact point measuring step S10, an etching preparing step S20, an initial value setting step S30, an etching step S40, and a process-end determining step S50.

At the contact point measuring step S10, a cathode rod 1 activated with a negative voltage is sunk into an electrolyte 5 within a container. A cylindrical electrode 3, having a predetermined length and activated with a positive voltage, is fed to the surface of the electrolyte 5 until the electrode 3 comes into contact with the electrolyte 5 while measuring a contact point, at which an electric current initially flows into the electrolyte 5. This contact point measuring step S10 is the first step of the etching process of this invention.

The object of performing the contact point measuring step S10 is to measure the influence of the surface tension of the electrolyte 5 upon the electrode 3 when the electrode 3 acting as the anode is sunk into the electrolyte, and to allow the electrode 3 to be more precisely machined in the etching step.

At the etching preparing step S20, the electrode 3 is fed to the surface of the electrolyte 5. Thereafter, the applied voltage is removed from the electrode 3 before the electrode 3 is sunk into the electrolyte 5 by a length, which is predetermined on the basis of the contact point and to which the electrode 3 has to be etched.

The initial value setting step S30 is performed to set the target length of the electrode 3, the target diameter of the electrode 3, the electrochemical equivalent volume constant of the electrode 3, the current density, and the etching intervals.

At the etching step S40, the electrode 3 is electrochemically machined in response to voltages applied to the electrode 3 and the cathode rod 1. At this step S40, it is necessary to continuously calculate and measure a change in the surface area of the electrode 3, the amount of applied current, the amount of electricity according to the applied current and the variable diameter of the electrode 3 in accordance with the lapse in processing time during etching.

At the process-end determining step S50, it is determined whether the diameter of the machined electrode 3 from the etching step S40 is equal to the target diameter, thus repeating the etching step S40 until the target diameter of the workpiece 3 is accomplished. Of course, the etching step S40 is ended when the target diameter of the electrode 3 is accomplished. This process-end determining step S50 is the final step of the etching process of this invention.

In the electrochemical process of this invention comprising the above-mentioned five steps, both the amount of applied current and the current density are properly and steadily controlled by a computer in accordance with the physical and chemical properties of the electrode 3, thus creating a diffusion effect capable of compensating for the conventional geometric effect. Such a diffusion effect thickens the tip of the cylindrical electrode, thus preferably and effectively compensating for the conventional geometric effect sharpening the tip of the electrode. Therefore, the electrochemical process of this invention produces a precise product having a uniform diameter along its length due to the preferred compensation of the diffusion effect for the conventional geometric effect. In order to achieve the above object, it is necessary to properly control both the amount of applied current and current density so as to maintain the metal dissolution rate of the electrode 3 and the ion diffusion rate of the electrode 3 during the electrochemical process.

In order to accomplish the precise results of the electrochemical process according to this invention, the electrode 3 is ultrasonically washed on its surface with both acetone and distilled water before the contact point measuring step S10. It is thus possible to remove impurities from the surface of the electrode 3.

Figure 2:
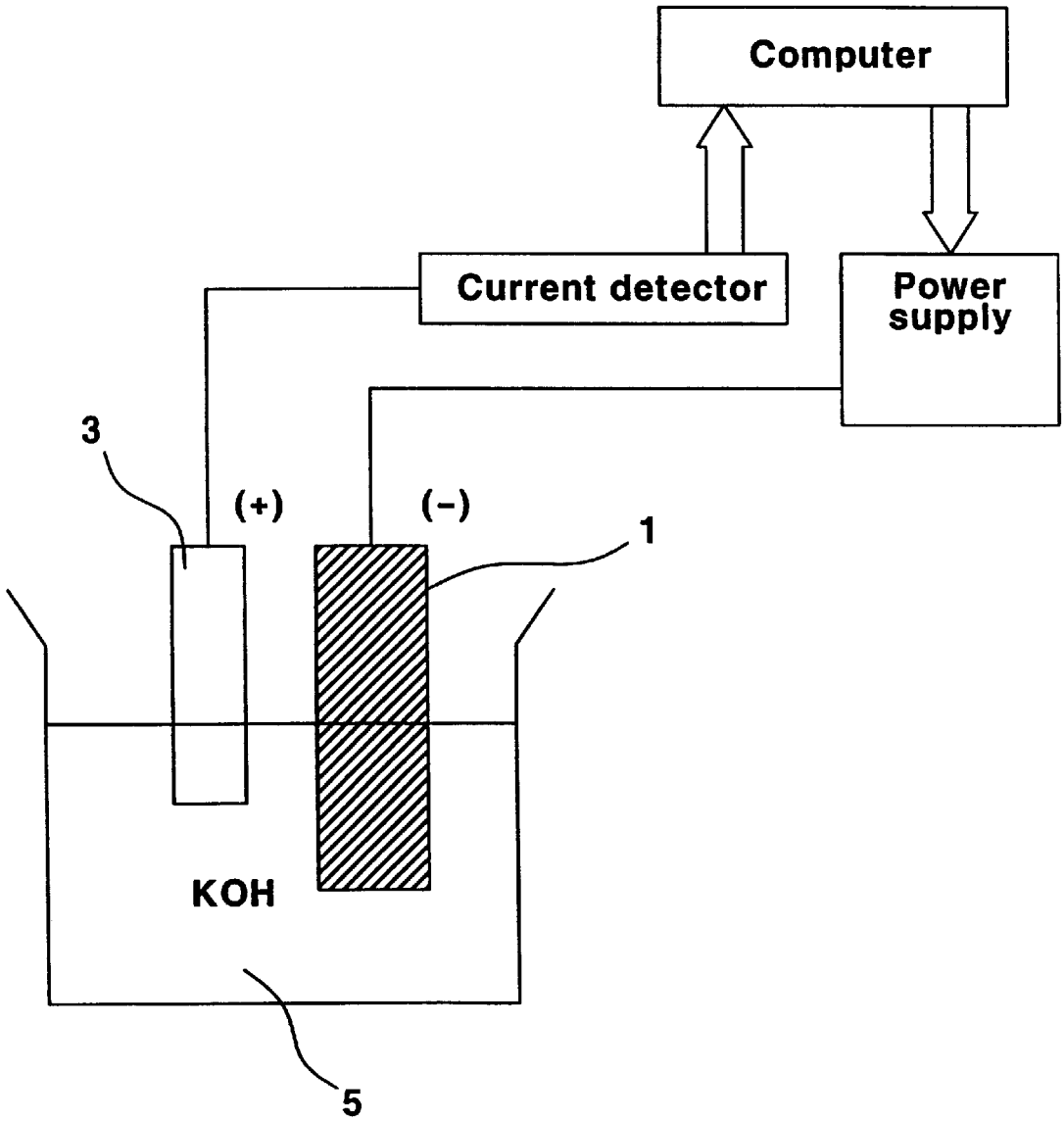
FIG. 2 is a diagram, showing a system for performing the electrochemical process using the current density controlling techniques in accordance with the preferred embodiment of this invention.

The position of the cathode rod 1, the workpiece 3 and the electrolyte 5 during the electrochemical machining process of this invention is shown in FIG. 2.

FIG. 2, is a diagram, showing a system for performing the electrochemical process using the current density controlling techniques in accordance with the preferred embodiment of this invention.

As shown in FIG. 2, the electrochemical process of this invention is performed with the electrolyte 5, which is a potassium hydroxide solution having a molar density of 4~6 M and contained with a container having a predetermined size. Both the cathode rod 1 acting as the cathode and the electrode 3 acting as the anode are sunk into the electrolyte 5, and are activated with electricity applied from a power source under the control of the computer. The excess metal of the electrode 3 is thus electrochemically dissolved into the electrolyte 5, and so the workpiece 3 is machined to become the desired product.

During such an electrochemical process, the variable surface area of the electrode 3, the amount of applied current, the amount of applied electricity, and the variable diameter of the electrode 3 are calculated by the computer in response to input signals sent from a current detector. The calculated results are displayed on a display under the control of the computer. During the electrochemical process, the computer controls the power supply to apply an electric current to both the cathode rod 1 and the electrode 3 while controlling the current until the electrode 3 is machined to accomplish the target diameter.

Figure 3:
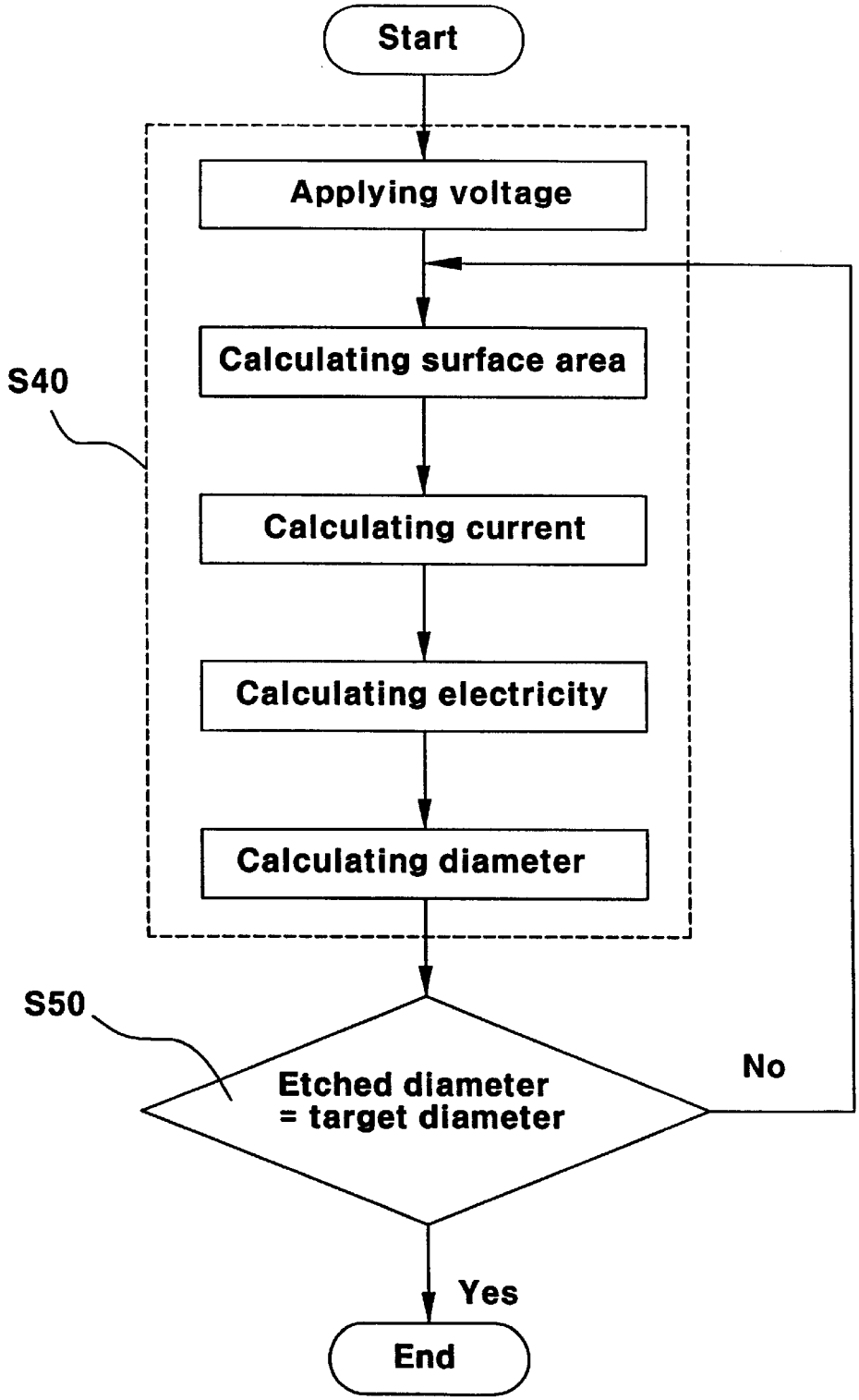
FIG. 3 is a flowchart, showing in detail the flow of both the etching step and the process-end determining step included in the electrochemical process of FIG. 1.

FIG. 3 is a flowchart, showing in detail the flow of both the etching step S40 and the process-end determining step S50 included in the electrochemical process of FIG. 1.

As shown in FIG. 3, the etching step S40 is started after the target length, the target diameter, and the electrochemical equivalent volume constant of the electrode 3, the current density, and the etching intervals are set in the initial value setting step S30.

At the etching step S40, both the cathode rod 1 acting as the cathode and the electrode 3 acting as the anode, which are sunk into the electrolyte 5, are activated with electricity applied from the power source under the control of the computer. Therefore, the excess metal of the electrode 3 is electrochemically dissolved into the electrolyte 5, thus being machined into a desired product. In such a case, the variable surface area of the electrode 3, the amount of applied current, the amount of applied electricity, and the variable diameter of the electrode 3 are continuously calculated and measured by the computer in accordance with the lapse in processing time during etching.

This etching step S40 is continuously repeated until the diameter of the machined electrode 3 becomes the target diameter. When it is determined at the process-end determining step S50 that the diameter of the machined electrode 3 from the etching step S40 becomes the target diameter, the etching step S40 is ended.

Figure 5:
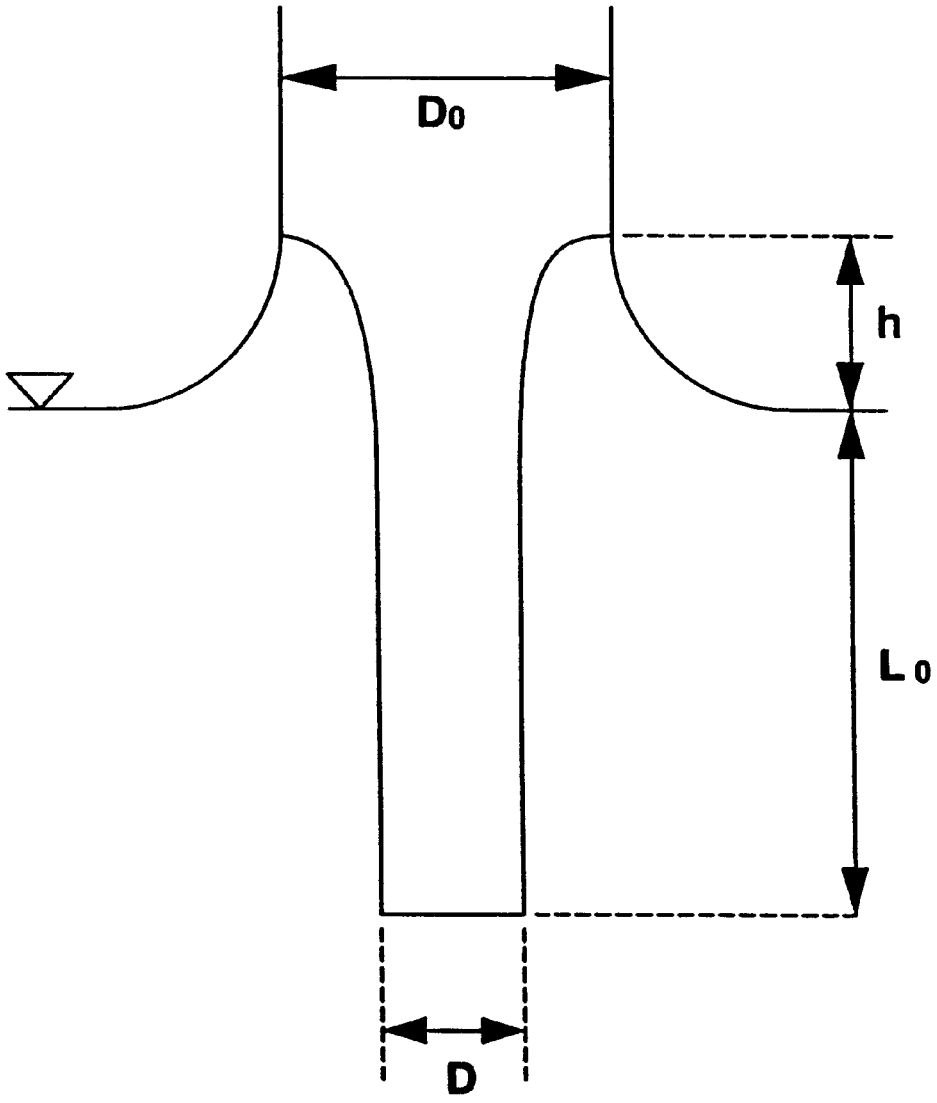
FIG. 5 is an illustration depicting an electrode during etching.

FIG. 5 is an illustration depicting the electrode during etching.

In such a case, the variable surface area of the electrode 3 during the etching step S40 is calculated by the expression $A_m=\pi[LD+h(D_o+2D)/3]$ (see FIG. 5), wherein $A_m$ is the variable surface area ($mm^2$) of the electrode 3 during etching, L is the target length (mm) of the electrode 3, h is the contact length (mm) of the electrode 3 due to the surface tension, D is the variable diameter (mm) of the electrode 3 during etching, and $D_o$ is the original diameter (mm) of the electrode 3.

In addition, the amount of applied current during the etching step S40 is calculated by the expression $i=A_mJ$, wherein i is the current (C/sec) applied to the cathode rod and the electrode during the unit of time (sec), $A_m$ is the variable surface area ($mm^2$) of the electrode 3 during etching, and J is the current density ($C/mm^2sec$)

On the other hand, the amount of electricity according to the applied current during the etching step S40 is calculated by the expression $Q_t=Q_p+i\Delta t$, wherein $Q_t$ is the total amount of applied electricity (C) during etching, $Q_p$ is the amount of electricity (C) applied during the previous step, and $\Delta t$ is the variable etching time (sec).

The variable diameter of the electrode 3 during the etching step S40 is calculated by the expression $\pi(D_o-D)[L(D_o+D)/4+h(3D_o+2D)/15]\alpha_e=Q_t$ (see FIG. 5), wherein D is the variable diameter (mm) of the electrode 3 during etching, $D_o$ is the original diameter (mm) of the electrode 3, $Q_t$ is the total amount of applied electricity (C) during etching, L is the target length (mm) of the electrode 3, h is the contact length (mm) of the electrode 3 due to the surface tension, and $\alpha_e$ is the electrochemical equivalent volume constant ($mm^3/C$) of the electrode 3.

Figure 4:
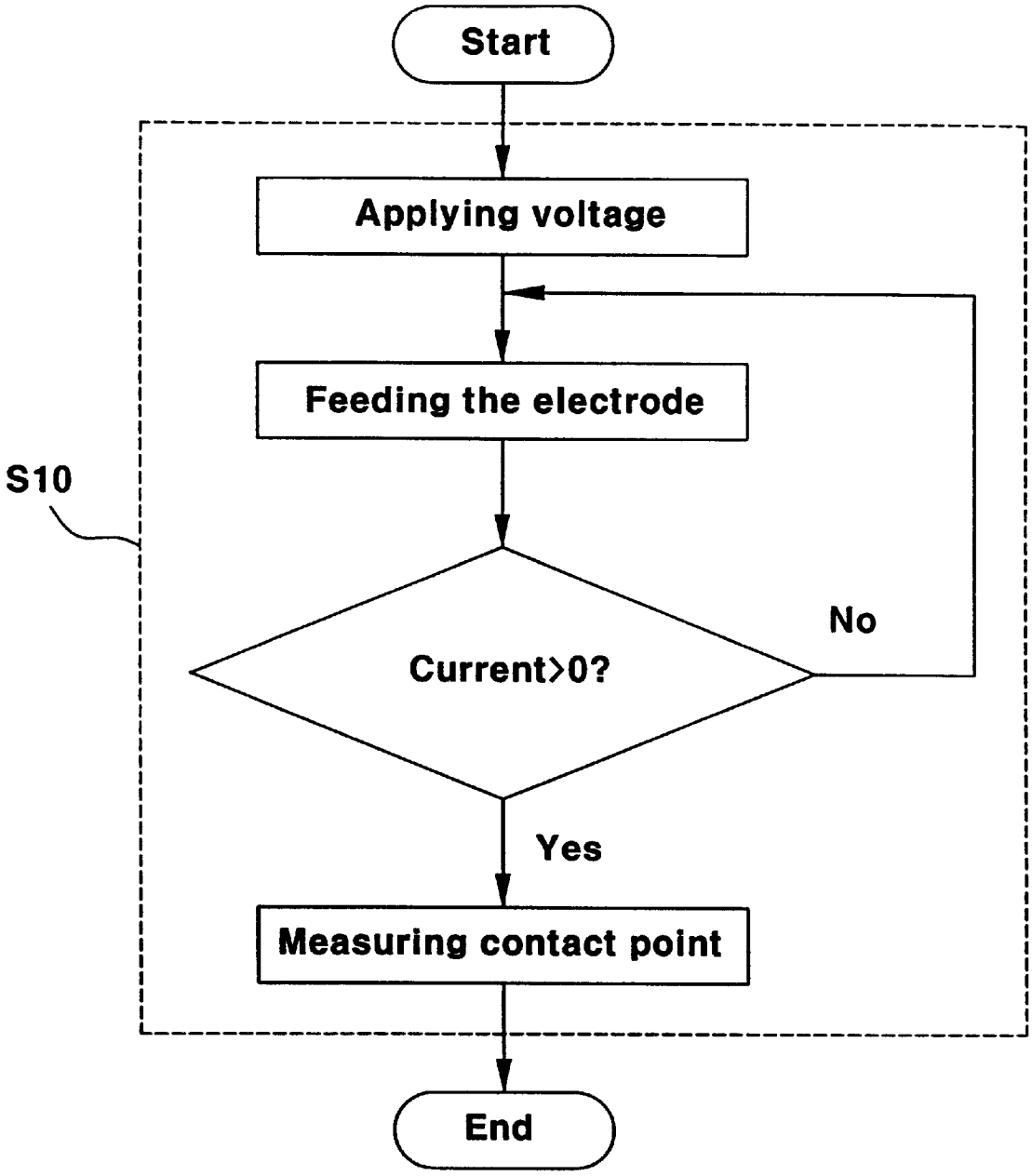
FIG. 4 is a flowchart, showing in detail the flow of the contact point measuring step included in the electrochemical process of FIG. 1.

FIG. 4 is a flowchart, showing in detail the flow of the contact point measuring step S10 included in the electrochemical process of FIG. 1.

As shown in FIG. 4, at the contact point measuring step S10, the cathode rod 1 activated with a negative voltage is primarily sunk into the electrolyte 5 within the container. On the other hand, the cylindrical electrode 3 activated with a positive voltage is secondarily fed to the surface of the electrolyte 5 until the electrode 3 initially comes into contact with the electrolyte 5 while measuring the contact point, at which an electric current initially flows into the electrolyte 5. That is, when the electrode 3 activated with the positive voltage initially comes into contact with the electrolyte 5, an electric current initially flows in the electrolyte 5 due to the negative voltage applied to the cathode rod 1 sunk into the electrolyte 5. It is thus possible to precisely sense the current initially flowing in the electrolyte 5 and measure the desired contact point.

The object of performing the contact point measuring step S10 is to measure the influence of the surface tension of the electrolyte 5 upon the electrode 3 during the etching step and to allow the electrode 3 to be more precisely machined in the etching step. When the contact point is precisely measured, it is possible to calculate an additionally machined volume of metal of the electrode 3 due to the surface tension of the electrolyte 5 upon the electrode 3. The additionally machined volume of metal of the electrode 3 due to the surface tension is calculated by the expression $V_p=\pi h(-2D^2-D_oD+3D_0^2)/15$ (see FIG. 4), wherein $V_p$ is the additionally machined volume ($mm^3$) of metal of the electrode 3 due to the surface tension, h is the contact length (mm) of the electrode 3 due to the surface tension, D is the variable diameter (mm) of the electrode 3 during etching, and $D_o$ is the original diameter (mm) of the electrode 3.

In the preferred embodiment of the present invention, the cathode rod 1 is a carbon rod, while the electrolyte 5 is a potassium hydroxide solution. However, it should be understood that the materials of both the cathode rod 1 and the electrolyte 5 may be freely changed without affecting the function of this invention. In addition, it is possible to machine desired products having a variety of shapes by properly changing the processing conditions, such as the amount of applied current, current density and molar density of electrolyte during the etching process.

As described above, the present invention provides an electrochemical process using current density controlling techniques. In the electrochemical process of this invention, it is possible to electrochemically machine an electrode while properly controlling both the metal ion dissolving rate of the electrode and the metal ion diffusing rate of the electrode by controlling the amount of the applied current to make the two rates maintain a desired balance. This electrochemical process thus effectively produces a precise product having a uniform diameter along its length. In addition, when the electrochemical process is performed while properly changing the processing conditions, it is possible to produce a variety of products having different diameters. Another advantage of the electrochemical process of this invention resides in that the process is performed in consideration of an influence created by the surface tension of the electrolyte on an electrode, and so it is possible to more precisely machine electrodes.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An electrochemical process using current density controlling techniques, comprising:

(1) measuring a contact point, including:
  (1) sinking a cathode rod activated with a negative voltage into an electrolyte within a container; and
  (2) feeding a cylindrical electrode having a predetermined length and activated with a positive voltage toward a surface of said electrolyte until the electrode comes into contact with the electrolyte while measuring a contact point, at which an electric current initially flows into the electrolyte;

(2) preparing for etching, including:
  (1) feeding the electrode to the surface of the electrolyte
  (2) removing the applied voltage from the electrode; and
  (3) sinking the electrode in the electrolyte by a length, which is predetermined on the basis of said contact point and to which the electrode has to be etched;

(3) setting initial values, including: a target length of the electrode, a target diameter of the electrode, an electrochemical equivalent volume constant of the electrode, a current density, and etching intervals;

(4) etching, including:
  (1) applying voltages to both the electrode and the cathode rod to electrochemically machine the electrode; and
  (2) continuously obtaining a variable surface area of the electrode, the amount of applied current, the amount of electricity according to the applied current, and a variable diameter of the electrode in accordance with a lapse in etching time; and (5) determining whether the diameter of the machined electrode from the etching is equal to the target diameter, thus repeating the etching until the target diameter of the electrode is accomplished or stopping the etching when the target diameter of the electrode is accomplished.

2. The electrochemical process according to claim 1, wherein said variable surface area of the electrode during the etching is calculated by the following expression $$A_m=\pi[LD+h(D_o+2D)/3]$$

wherein $A_m$ is the variable surface area ($mm^2$) of the electrode during etching, L is a target length (mm) of the electrode, h is a contact length (mm) of the electrode due to surface tension, D is the variable diameter (mm) of the electrode during etching, and $D_o$ is an original diameter (mm) of the electrode.

3. The electrochemical process according to claim 1, wherein said amount of applied current during the etching is calculated by the following expression $$i=A_mJ$$

wherein i is the applied current (C/sec) during a unit of time, $A_m$ is the variable surface area ($mm^2$) of the electrode during etching, and J is the current density ($C/mm^2$see).

4. The electrochemical process according to claim 1, wherein said amount of electricity during the etching is calculated by the following expression $$Q_t=Q_p+i\Delta t$$

wherein $Q_t$ is the total amount of applied electricity (C) during etching, $Q_p$ is the amount of electricity (C) applied during a previous step, and $\Delta t$ is a variable etching time (sec).

5. The electrochemical process according to claim 1, wherein said variable diameter of the electrode during the etching is calculated by the following expression $$\pi(D_o-D)[L(D_o+D)/4+h(3D_o+2D)/15]\alpha_e=Q_t$$

wherein

D is the variable diameter (mm) of the electrode during etching, $D_o$ is an original diameter (mm) of the electrode, $Q_t$ is the total amount of applied electricity (C) during etching, L is a target length (mm) of the electrode, h is a contact length (mm) of the electrode due to surface tension, and $\alpha_e$ is the electrochemical equivalent volume constant ($mm^3/C$) of the electrode.

6. The electrochemical process according to claim 1, wherein both a metal ion dissolving rate and a metal ion diffusing rate of the electrode are controlled by controlling the amount of the applied current.

7. The electrochemical process according to claim 1, wherein said cathode rod is a carbon rod.

8. The electrochemical process according to claim 1, wherein said electrolyte is a potassium hydroxide solution.

9. The electrochemical process according to claim 8, wherein said potassium hydroxide solution has a molar density of 4~6 M.

10. The electrochemical process according to claim 1, wherein said electrode is ultrasonically washed on its surface with both acetone and distilled water before the contact point measuring step so as to remove impurities from the surface of the electrode.

11. The electrochemical process according to claim 1, wherein an additionally machined volume of metal of the electrode due to surface tension is calculated by the following expression $$V_p=\pi h(-2D^2-D_oD+3D_0^2)/15$$

wherein $V_p$ is the additionally machined volume ($mm^3$) of metal of the electrode due to the surface tension, h is an additional increase (mm) of the contact position of the electrolyte surface, D is the variable diameter (mm) of the electrode during etching, and $D_o$ is an original diameter (mm) of the electrode.

* * * * *